US005816232A

United States Patent [19]

Bell

[11] Patent Number: 5,816,232

[45] Date of Patent: Oct. 6, 1998

[54] PAINTBALL LOADER HAVING ACTIVE FEED MECHANISM

[75] Inventor: David W. Bell, Mesquite, Tex.

[73] Assignee: CM Support, Inc., Dallas, Tex.

[21] Appl. No.: 856,775

[22] Filed: May 15, 1997

[51] Int. Cl.[6] ..... F41B 11/02

[52] U.S. Cl. ..... 124/51.1; 124/48; 221/258; 221/277

[58] Field of Search ..... 124/48, 49, 51.1, 124/56, 73, 74, 82; 221/13, 258, 277

[56] References Cited

U.S. PATENT DOCUMENTS

| | | | |
|---|---|---|---|
| 1,403,719 | 1/1922 | Szepe | 124/50 X |
| 1,404,689 | 1/1922 | Fairweather | 124/51.1 X |
| 1,743,576 | 1/1930 | Smith | 124/49 X |
| 3,248,008 | 4/1966 | Meierjohan | 221/277 X |
| 3,610,223 | 10/1971 | Green | 124/50 X |
| 3,695,246 | 10/1972 | Filippi | 124/51.1 X |
| 3,844,267 | 10/1974 | Mohr | 124/49 X |
| 3,867,921 | 2/1975 | Politzer | 124/50 X |
| 4,027,646 | 6/1977 | Sweeton | 124/56 |
| 4,207,857 | 6/1980 | Balka | 124/56 |
| 5,097,985 | 3/1992 | Jones | 221/277 X |
| 5,282,454 | 2/1994 | Bell | 124/49 |
| 5,505,188 | 4/1996 | Williams | 124/74 |

*Primary Examiner*—John A. Ricci
*Attorney, Agent, or Firm*—Haynes and Boone, L.L.P.

[57] ABSTRACT

An active feed loader for a paintball gun. The active feed loader includes a generally horizontal interior passageway or channel having a first end in communication with an interior space of the housing where paintballs are housed. A rotatable paddle positioned in the interior space forces paintballs out of the housing and through the interior passageway or channel until they drop through an opening therein into a vertical outfeed tube where they form a paintball stack. When the paintball gun is fired, the paintball stack is depleted until a sensor detects the absence of a paintball at a specified location within the outfeed tube. Upon detecting the absence, the sensor activates a motor which rotates the paddle to force paintballs through the interior passageway and into the outfeed tube where they replenish the paintball stack. When the stack is fully replenished, the sensor will detect the presence of a paintball at the specified location and deactivate the motor, thereby stopping the paddle. If the loader includes a channel, an elongated top wall of a directional plug prevents paintballs from dropping into a open top end thereof.

39 Claims, 4 Drawing Sheets

PAINTBALL LOADER HAVING ACTIVE FEED MECHANISM

BACKGROUND OF THE INVENTION

1. Field of the Invention

The present invention generally relates to paintball loaders, and more particularly, relates to a paintball loader having a motor-driven active feed mechanism for forcibly directing paintballs to an infeed opening of a paintball gun.

2. Description of Related Art

The game of paintball has enjoyed great success in recent years. In the game, each one of two or more teams try to capture the opposing team's flag. The players on the teams each carry a compressed air-powered gun that shoots paintballs—gelatin covered spherical capsules which contain a colored liquid—a considerable distance. When a player is hit with a paintball fired from a gun, the paintball ruptures and leaves a colored "splat" on the hit player who is then "out" and must leave the game. As the game of paintball has grown in sophistication, semi-automatic paintball guns—guns that sequentially fire individual paintballs as fast as the trigger can be repeatedly pulled—have become more prevalent. The high firing rate capability of semi-automatic paintball guns has necessitated the use of bulk paintball loaders in conjunction with such guns.

In a conventional form thereof, a bulk paintball loader typically comprises a housing which is positioned above and slightly to one side of the paintball gun. The housing is adapted to internally store a relatively large quantity of paintballs, for example, 100–200 paintballs, and has a bottom outlet opening through which the stored paintballs can sequentially drop. Connected to the housing over its bottom outlet opening, and extending downwardly therefrom, is an outfeed tube that is connectable to the paintball gun's hollow infeed portion—typically a hollow elbow member projecting outwardly from the body of the paintball gun.

During normal operation of the loader, paintballs dropped through the bottom outlet opening of the housing form a paintball stack, within the outfeed tube and gun infeed elbow, that is dropped into the firing chamber of the paintball gun and replenished at its top end from the loader housing. Paintball jams intermittently occur within the loader housing, above its bottom outlet opening, during firing of the paintball gun. These jams prevent normal gravity-fed delivery of paintballs downwardly through the bottom outlet opening, with the result that the paintball stack can be totally depleted by several shots of the paintball gun.

In the past, clearing of such jams has required the paintball gun be forcibly shaken to dislodge the paintballs causing the jam within the loader housing. This, of course, is highly undesirable since it interrupts the proper aiming of the paintball gun and, of course, correspondingly interrupts the paintball gun user's ability to continue the rapid firing of the paintball gun. In our prior patent, U.S. Pat. No. 5,282,454 to Bell et al., these deficiencies in prior paintball loaders were overcome by incorporating ajam clearing system into the paintball loader device. The jam clearing system included an agitator disposed within the housing and an optical circuit for detecting the absence of paintballs at a specified location within the outfeed tube. Upon detection of the absence of a paintball at the specified location within the outfeed tube, the optical circuit would close, thereby turning on a stepper motor which would cause the agitator to begin to rotate. In turn, the rotating motion of the agitator would break up the paintball jam within the loader, thereby allowing paintballs to be gravity-fed into the feed tube, opening the optical circuit and turning off the stepper motor.

While representing a significant advancement in the ability of paintball loaders to reliably deliver a constant supply of paintballs to a paintball gun, various characteristics of our prior paintball loader prevented optimization of its ability to deliver paintballs to a paintball gun. First, while including a motor-driven agitator, our prior paintball loader is still a member of the family of gravity-feed loaders. As the firing speed of paintball guns increases, it has become apparent that gravity-feed loaders cannot supply paintballs to the feed tube as fast as the paintball gun is able to fire them. Secondly, the agitator was non-directionalized, i.e. it simply shuffled paintballs within the loader housing. Thus, paintballs forcibly moved by the agitator would typically be directed away from the bottom outlet opening. As a result therefore, the agitator motion did not always directly assist in the delivery of paintballs to the paintball gun. Finally, in order to operate, gravity-feed paintball loaders must always be positioned above the infeed tube of the paintball gun. In view of the continuing evolution in the design of paintball guns, such inflexibility of gravity-feed paintball loaders has proven undesirable. In view of all of the foregoing, it is the object of the present invention to provide an active feed paintball loader configured to forcibly direct paintballs from the loader housing to the infeed tube of the paintball gun.

SUMMARY OF THE INVENTION

In one embodiment, the present invention is of an active feed loader having a walled housing which defines an interior space for storing paintballs therein. An interior passageway has a first end in communication with the interior space of the housing and a second end configured for communication with an infeed tube of a paintball gun. A rotatable paddle is positioned in the interior space of the housing. A sensor is positioned to detect the absence of a paintball at a specified location within the interior passageway and, upon detecting the absence, the sensor activates a motor which rotates the paddle to forcibly direct at least one of the paintballs out of the interior space and into the interior passageway.

In one aspect thereof, the paddle is comprised of a central body portion and arms which extend outwardly from the central body portion. Each one of the arms is spaced apart from an adjacent arm such that a paintball may be retained therebetween. In one alternate aspect thereof, the paddle is comprised of a central body portion having a peripheral edge side surface and arms which extend outwardly from the central body portion. An edge surface of each one of the arms, an edge surface of an adjacent arm and a portion of the peripheral edge side surface which extends therebetween forms a semi-circular recess within which a paintball may be retained. In another alternate aspect thereof, the paddle is comprised of a central body portion, a downwardly sloping intermediate body portion having an upper side surface divided into sections by ridges formed thereon and arms which radiate outwardly from a corresponding one of the ridges of the intermediate body portion. An edge surface of one of the arms, an edge surface of an adjacent arm and a portion of a peripheral edge side surface of the intermediate body portion which extends therebetween forming a generally semi-circular recess within which a paintball channeled thereto by one of the section of the upper side surface may be retained. In a further aspect of each of these alternate aspects, the central body portion is dome-shaped to channel paintballs towards the semi-circular recesses.

In another aspect, the housing further includes a lower sidewall which defines a generally cylindrical lowered portion where the paddle is positioned. In one further aspect thereof, the opening at the first end of the interior passageway is formed in the lower sidewall. In another, the housing includes a bottom wall and an interior wall which extends from the bottom wall and into the generally cylindrical lowered portion of the interior space. In this aspect, the paddle is positioned above a top side surface of the interior wall. Paintballs driven by the rotating paddle are guided into the interior passageway by the interior wall. In still another aspect of this embodiment of the invention, the interior passageway is generally horizontal and extends beneath the walls of the housing.

In another embodiment, the present invention is of an active feed paintball loader having a housing which includes an upper interior space defined by walls thereof and a lower interior space, in communication with the upper interior space, defined by a lower sidewall thereof. A generally horizontal interior passageway extends, from a first opening in communication with the lower interior space of the housing, beneath the walls which define the upper interior space of the housing and to a second opening in communication with an outfeed tube. The loader also includes a sensor for detecting the absence of a paintball at a specified location within the outfeed tube. Upon detecting such an absence, the sensor activates a motor which rotates a paddle positioned in the lower interior space of the housing to force paintballs stored therein out of the interior space, through the interior passageway and into the outfeed tube.

In one aspect thereof, one end of the outfeed tube is adapted for attachment to a paintball gun such that the outfeed tube communicates with an infeed tube of the paintball gun. In another aspect thereof, paintballs entering the outfeed tube form a paintball stack. In this aspect, the sensor activates the motor to rotate the paddle when the paintball stack has been sufficiently depleted such that the sensor detects the aforementioned absence. Paintballs forced through the interior passageway and into the outfeed tube by rotation of the paddle replenish the paintball stack, thereby deactivating the motor. In still another aspect thereof, the housing includes a bottom wall and an interior wall which extends from the bottom wall and into the lower interior space. In this aspect, the paddle is positioned above a top side surface of the interior wall such that the interior wall guides paintballs driven by the rotating paddle into the interior passageway.

In still further aspects thereof, the outfeed tube has an entrance aperture through which the outfeed tube communicates with the upper interior space and the interior passageway has a third opening at a second end thereof. A directional plug rotatable between a first position in which the directional plug blocks paintballs from entering the outfeed tube through the entrance aperture and a second position in which paintballs are free to enter the outfeed tube through the entrance aperture is inserted in the third opening of the interior passageway.

In still another embodiment, the present invention is of an active feed paintball loader which includes a housing mounted to a body of the paintball gun, a vertical outfeed tube having an inlet end and an outlet end coupled to an infeed tube of the paintball gun and an active feed tube having an inlet end in communication with an interior space of the housing in which paintballs are stored and an outlet end coupled to the inlet end of the outfeed tube. A sensor is positioned to detect an absence of a paintball at a specified location within the outfeed tube. Upon detecting such an absence, the sensor activates a motor which rotates a paddle positioned in the interior space of the housing. The paddle forces paintballs out of the interior space, through the active feed tube and to the inlet end of the outfeed tube where they are dropped to form a paintball stack. The sensor activates the motor to rotate the paddle when the paintball stack has been sufficiently depleted and rotation of the paddle forces paintballs through the active feed tube and to the outfeed tube for dropping onto the paintball stack for replenishment thereof. In one aspect thereof, the housing is mounted above an interior firing chamber of the paintball gun and, in another aspect thereof, the housing is mounted below the interior firing chamber.

In still yet another embodiment, the present invention is of an active feed paintball loader having a housing which includes an upper interior space defined by walls thereof and a lower interior space, in communication with the upper interior space, also defined by walls thereof. A channel formed in a bottom wall of the walls defining the upper interior space extends from a first opening in communication with the lower interior space of the housing to a second opening in communication with an outfeed tube. The loader also includes a sensor for detecting the absence of a paintball at a specified location within the outfeed tube. Upon detecting such an absence, the sensor activates a motor which rotates a paddle positioned in the lower interior space of the housing to force paintballs stored therein out of the interior space, through the first opening and the channel and into the outfeed tube.

In one aspect thereof, one end of the outfeed tube is adapted for attachment to a paintball gun such that the outfeed tube communicates with an infeed tube of the paintball gun. In another aspect thereof, paintballs entering the outfeed tube form a paintball stack. In this aspect, the sensor activates the motor to rotate the paddle when the paintball stack has been sufficiently depleted such that the sensor detects the aforementioned absence. Paintballs forced through the channel and into the outfeed tube by rotation of the paddle replenish the paintball stack, thereby deactivating the motor. In still another aspect thereof, the walls which define the lower interior space includes a bottom wall and an interior wall which extends from the bottom wall and into the lower interior space. In this aspect, the paddle is positioned above a top side surface of the interior wall such that the interior wall guides paintballs driven by the rotating paddle into the channel. In still another aspect thereof, a directional plug having an elongated top wall which blocks paintballs from entering the channel through an open top end thereof is inserted in a third opening in the channel.

BRIEF DESCRIPTION OF THE DRAWING

The invention will be better understood and its numerous objects and advantages will become apparent to those skilled in the art by reference to the following drawing in which.

DETAILED DESCRIPTION

Figure 1:
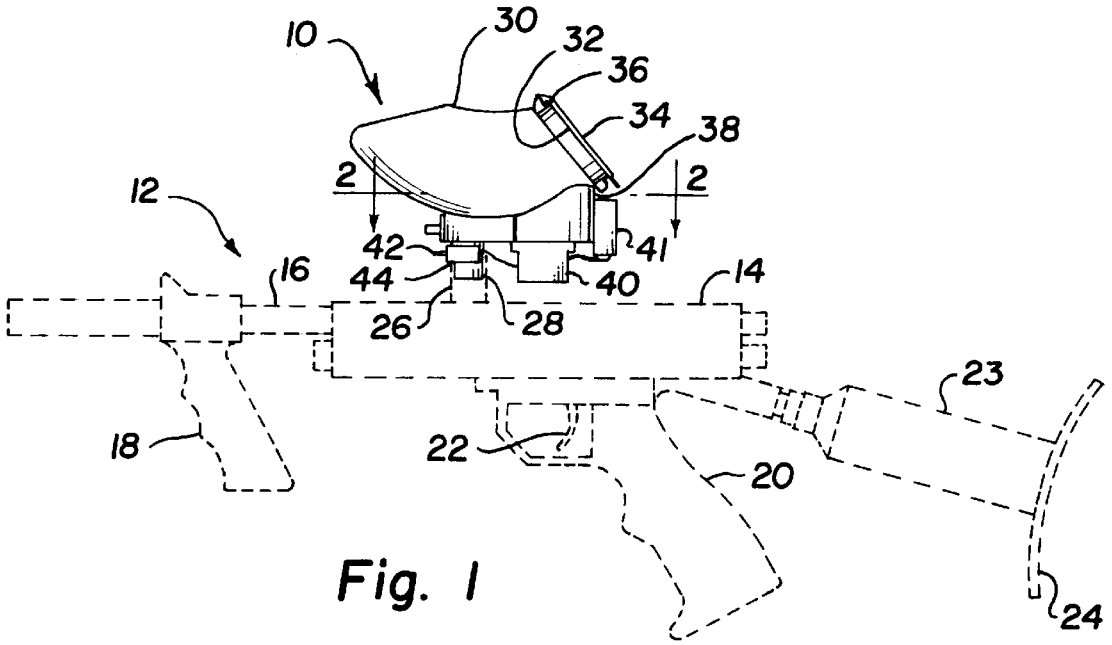
FIG. 1 is a side elevational view of a bulk paintball loader constructed in accordance with the teachings of the present invention and operatively attached to a representative paintball gun illustrated in phantom.

Referring first to FIG. 1, a bulk paintball loader 10 constructed in accordance of the teachings of the present invention and operatively connected to a paintball gun 12 may now be seen. The paintball gun 12 is representatively of the semi-automatic firing type and has a body portion 14, a barrel 16 with a front handgrip 18 generally downwardly depending therefrom, a central handgrip 20 having a trigger 22 and a rear stock portion which includes a canister 23 filled with a compressed gaseous propellant, for example, air, nitrogen or carbon dioxide, and a shoulder rest 24. Of course, the semi-automatic paintball gun 12 is purely exemplary and the paintball loader 10 is equally suitable for use with other types of paintball guns, for example, fully automatic paintball guns.

The paintball gun 12 is conventionally fitted with an infeed tube 26 having an interior passageway extending therethrough. The inner or bottom end of the infeed tube 26 communicates with a firing chamber (not shown) within the body portion 14 of the paintball gun 12. In turn, the firing chamber is in operative communication with the compressed gas canister 23. The paintball loader 10 is mounted to an upper end of the infeed tube 26. Paintballs stored within the paintball loader 10 are supplied to the infeed tube 26 where they are dropped into the firing chamber for sequential firing thereof by pressure bursts of gas from the canister 23 which are produced by sequential pulls of the trigger 22.

The paintball loader 10 includes an outfeed tube 28 having an interior passageway 72 and a main body portion 30 which define an interior space 31 in communication with the interior passageway 72 of the outfeed tube 28. The paintball loader 10 is coupled to the paintball gun 12 by inserting the outfeed tube 28 into the interior passageway (not shown) of the infeed tube 26 such that an outer side surface of the outfeed tube 28 frictionally engages an inner side surface of the infeed tube 26 and the respective interior passageways thereof are in communication with each other. Paintballs are housed in the interior space 31 of the paintball loader 10 until they are supplied, in a manner to be more fully described below, to the interior passageway 72 of the outfeed tube 28. There, the paintballs drop through the interior passageways of the outfeed tube 28 and the infeed tube 26 and into the firing chamber of the paintball gun 12.

Mounted on a rear end 32 of the main body portion 30 of the paintball loader 10 is a generally transparent, disc-shaped cap 34 that provides viewing access into the interior area of the main body portion 30. The transparent cap 34 may also be pivoted around a hinge structure 36 to allow access to the interior area of the main body portion 30. Paintballs stored in the interior space 31 of the main body portion 30 may be loaded through the, now open, rear end 32.

The paintball loader 10 further includes a lower body portion 38 which projects downwardly from, and is integrally formed with, the main body portion 30. As will be more fully described below, the lower body portion 38 effectively enlarges the interior space 31 by defining a generally cylindrical, lowered interior space 33 in communication with the interior space 31. A rotatable paddle 39, which is one component of a paintball active feed mechanism, is positioned within the lowered interior space 33 while, outside the lowered interior space 33, the lower body portion 38 houses the remaining components of the paintball active feed mechanism. These are an electric stepper motor 40 which drives the rotatable paddle 39, a power supply 41, for example, a 9 volt battery, which provides electric power for the stepper motor 40, a switch 42 for turning the paintball active feed mechanism on and off and an optical switch 44 for selectively activating the stepper motor 40 upon a failure to detect a paintball at a specified location within the outfeed tube 28.

Figure 2:
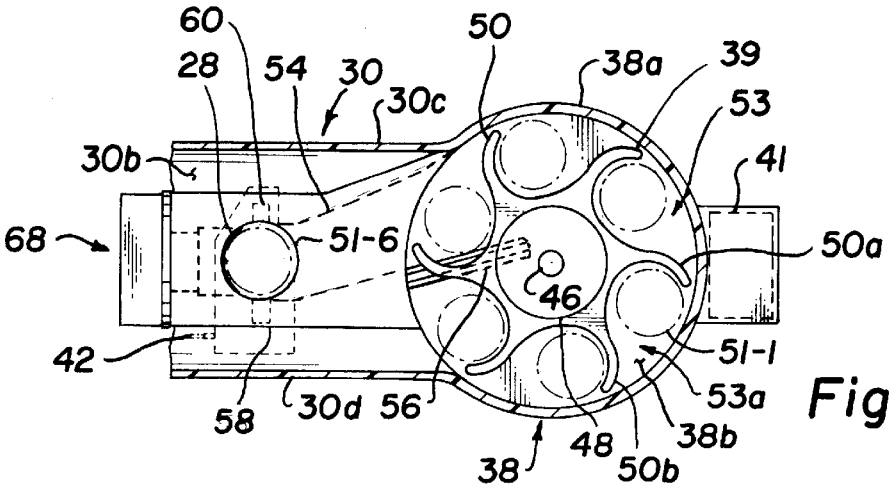
FIG. 2 is an enlarged cross-sectional view through the paintball loader of FIG. 1 taken along line 2—2 thereof.
Figure 2A:
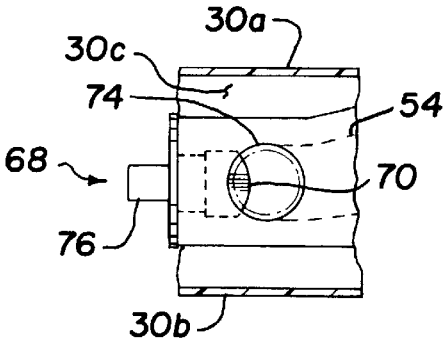
FIG. 2A is a second, partial, cross-sectional view of the paintball loader of FIG. 1 with a directional plug rotated 90° into an active feed operating position.
Figure 3:
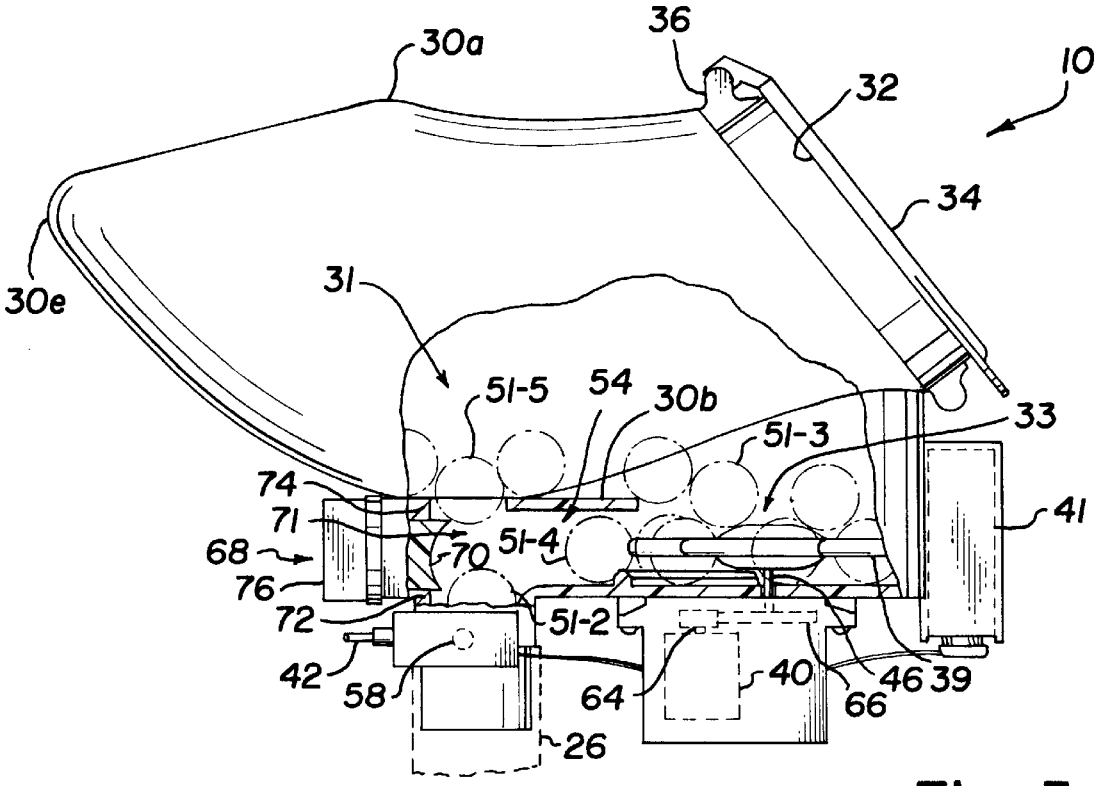
FIG. 3 is an enlarged scale, partially cut-away side elevational view of the paintball loader during active feed operation thereof.

Referring next to FIGS. 2 and 3, the paintball active feed mechanism will now be described in greater detail. As may now be seen, the interior area 31 of the main body portion 30 is defined by top wall 30*a*, bottom wall 30*b*, first interior side wall 30*c*, second interior side wall 30*d*, front wall 30*e* and the cap 34 while the lowered interior space 33 is defined by generally cylindrical side wall 38*a* and bottom wall 38*b*. The bottom wall 38*b* is lower than the bottom wall 30*b* such that paintballs placed in the interior area 31 of the paintball loader 10 will tend to fill the lowered interior space 33 defined by the lower body portion 38 first.

The paddle 39 is mounted above the bottom wall 38*b* of the lower body portion 38 and below the bottom wall 30*b* of the body portion 30. Shaft 46 is coupled to the stepper motor 40 such that, when the stepper motor 40 is on, the shaft 46 causes the paddle 39 to rotate in a counter clockwise direction. The paddle 39 is comprised of a central body portion 48 from which a series of arms 50 outwardly radiate, i.e. extend towards the side wall 38*a*, such that paintballs will be held in recesses 53 between a pair of adjacent arms and the sidewall 38. For example, a paintball 51-1 is held in recess 53*a* located between adjacent arms 50*a* and 50*b*. Preferably, the central body portion 48 is generally dome-shaped to channel paintballs towards the recesses 53. Also, the arms 50 should be curved similarly to the curvature of the paintballs so that the recesses 53 have a semi-circular shape and be spaced apart a sufficient distance to readily hold a paintball therebetween. When the lowered interior space 33 is filled with paintballs, certain ones of them will drop into the recesses 53 located between the arms 50 of the paddle 39. As the paddle 39 begins to rotate, the arms 50 forcibly direct the paintballs towards an interior passageway 54 located below the bottom wall 30*b*. As the paintballs being pushed towards the interior passageway 54 by the arms 50 of the paddle 39 near the interior passageway 58, the paintballs are guided into the interior passageway 54 by the sidewall 38*a* and a guide wall 56 which projects from the bottom wall 38*c*. The arms 50, on the other hand, pass over the guide wall 56 so that, during a next rotation of the paddle 39, the arms 50 may forcibly direct additional paintballs which drop into the recesses 53 between arms 50 into the interior passageway 54.

Figure 2B:
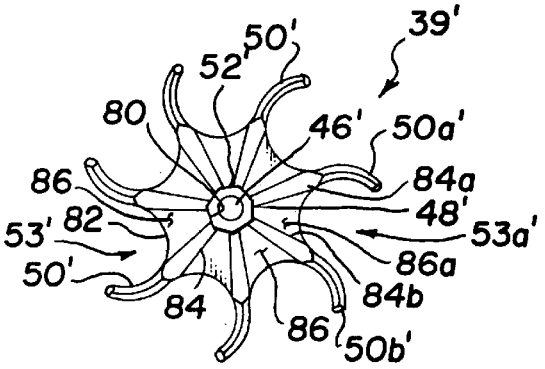
FIG. 2B is a top view of an alternate embodiment of a paddle member of the paintball loader of FIGS. 1–2.

Referring next to FIG. 2B, an alternate configuration of the paddle 39' may now be seen. The paddle 39' is comprised of an elevated central body portion 52', again, preferably dome-shaped, a downwardly sloping intermediate body portion 80 and a plurality of arms 50' which radiate outwardly from a peripheral edge surface 82 of the intermediate body portion 80. Formed on a top side surface of the intermediate body portion 80 are a series of outwardly radiating, downwardly sloping ridges 84 of uniform height which divide the top side surface of the downwardly sloping intermediate body portion 80 into a series of downwardly sloping sections 86. As paintballs are dropped into the lowered interior space 33, those striking the paddle 39 are channeled by the ridges 84 and downwardly sloping sections 86 into the semi-circular recesses 53' between adjacent ones of the arms 50'. Preferably, each one of the arms 50' are aligned with a corresponding one of the ridges 84 so that individual paintballs would be channeled by a pair of adjacent ridges and the downwardly sloping section therebetween into a semi-circular recess located between a pair of adjacent arms. For example, adjacent ridges 84*a* and 84*b* and downwardly sloping section 82*a* channel paintballs in the semi-circular recess 53*a'* located between adjacent arms 50*a'* and 50*b'*. As before, the central body portion 52' may be dome-shaped to further encourage the channelling of paintballs towards the recesses 50'.

Figure 4:
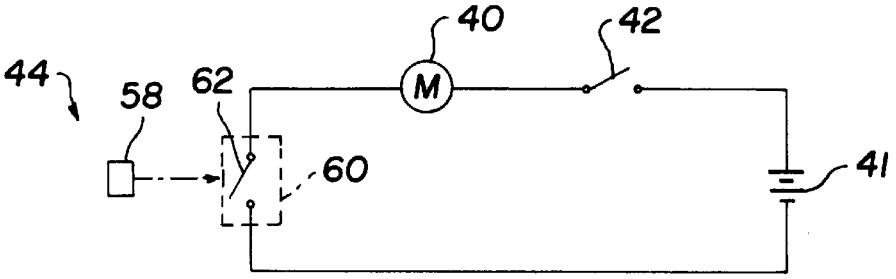
FIG. 4 is a schematic diagram of an optical circuit utilized in activating the motor-driven active feed mechanism of the paintball loader of FIGS. 1–3.

Referring next to FIG. 4, the operation of the motor driven active feed mechanism will be described in greater detail. The active feed mechanism is turned on by closing the switch 42. When the switch 42 is closed, the stepper motor 40 will be turned on and off by the optical switch 44. The optical switch 44 consists of an emitter 58 for generating a beam of infrared light and a receiver 60 for detecting the beam. The emitter 58 and the receiver 60 are positioned on opposite ends of the interior passageway 72 formed within the outfeed tube 28. For example, the optical switch 44 may be mounted to an outer side surface of the outfeed tube 28 and apertures formed in the outfeed tube 28 such that infrared light generated by the emitter 58 may pass through a first aperture, across the interior passageway 72 and through a second aperture where it is detected by the receiver 60. When infrared light generated by the emitter 58 is blocked from detection by the receiver 60, a switch portion 62 thereof remains open. If, however, the infrared light is detected by the receiver 60, the switch 62 closes, thereby enabling the power supply 41 to power the stepper motor 40.

Returning now to FIG. 3, the operation of the paintball loader 10 in providing an active feed of paintballs to the paintball gun 12 will now be described in greater detail. Starting from a fully loaded condition where a stack of paintballs (not shown) extends through the interior passageways of the infeed tube 26 and the outfeed tube 28, an uppermost paintball 51-2 of the paintball stack blocks the infrared beam generated by the emitter 58 from reaching the receiver 60. The switch 62 will, therefore, be open and the stepper motor 40 will be off. As the paintball gun 12 is fired, paintballs in the stack will be dropped, in sequence, into the firing chamber. As depletion of the stack of paintballs begins, the paintball 51-2 blocking the infrared beam from reaching the receiver 60 will drop lower into the stack and, since no additional paintballs are being forced through the interior passageway 54 and into the outfeed tube 28, the receiver 60 will detect the infrared beam being generated by the emitter 58. The switch 62 will close, thereby activating the electric motor 40. The electric motor 40 will cause output shaft 64 to rotate and, since the output shaft 64 is coupled by schematically depicted gear train 66 to the shaft 46 of the paddle 39, the paddle 39 will begin to rotate in a counter-clockwise direction.

As the paddle 39 rotates, paintballs retained in the recesses 53 between a pair of adjacent arms 50 and the sidewall 38 are forcibly directed out of the lower interior space 33 and into the interior passageway 54. As the paintballs enter the interior passageway 54, additional paintballs, for example, the paintball 51-3 will drop into the recently vacated recesses 53 between the paddle arms 50 where, they too, are retained and forcibly directed towards the interior passageway 54 by continued rotation of the paddle 39. When a sufficient number of paintballs have been forced into the interior passageway 54, the leading paintball, for example, the paintball 51-4, will be pushed to a juncture 71 of the interior passageway 54 and the interior passageway 74 and into the outfeed tube 28 where the paintball is dropped down the interior passageway 72 thereof and onto the paintball stack for replenishment thereof. Depending on the extent of depletion of the stack of paintballs, and the rate at which the remaining paintballs within the stack are being fired from the paintball gun 10, it may be necessary that a number of paintballs be forced through the interior passageway 54 and dropped into the interior passageway 72 of the outfeed tube 28 before the paintball stack has been replenished sufficiently so that the infrared beam generated by the emitter 58 is blocked from detection by the receiver 60. When the infrared beam is again blocked, the switch 62 opens, thereby deactivating the electric motor 40 off and stopping the paddle 39 from further rotation.

In addition to the active feed mode of operation described above, it should be further noted that the paintball loader 10 is also capable of operating in a traditional, gravity feed mode of operation. The ability to operate in both of these two, quite distinct, modes of operation is made possible by a directional plug 68 which, as best seen in FIG. 3, includes a curved interior side wall 70. The directional plug 68 is rotatably inserted into an opening at a second end of the interior passageway 54 to close the opening. As the second end of the interior passageway 54 is located in proximity to the juncture 71 between the horizontal interior passageway 54 located within the body portion 30 and the vertical interior passageway 72 located within the outfeed tube 28 such the directional plug 68 extends to the juncture 71, and the curved interior side wall 70 may be used to directionally control the flow of paintballs at the juncture 71. More specifically, the interior curved surface 70 may be adjusted from a first position where only an active feed of paintballs driven by the paddle 39 is permitted to a second position where a gravity feed of paintballs may take place. In the first position, the curved interior sidewall 70 blocks paintballs, for example, the paintball 51-5, from dropping through aperture 74 in the bottom wall 30*b* of the main body portion 30 and into the interior passageway 72 of the outfeed tube 28. When entry through the aperture 74 is blocked, only actively fed paintballs forced through the interior passageway 54 may drop into the interior passageway 72 of the outfeed tube 28. Additionally, the curved interior sidewall 70 tends to deflect balls propelled along the interior passageway 54 down towards the interior passageway 72 of the outfeed tube 28.

For gravity feed operation, handle 76 of the directional plug 68 is rotated 90 degrees to the position illustrated in FIG. 2. As may now be seen, the curved interior sidewall 70 no longer blocks paintballs, for example, the paintball 51-6 from dropping through the aperture 74 and into the interior passageway 72 of the outfeed tube 28. However, since it is still possible for additional paintballs to travel through the interior passageway 54, it is generally recommended that, if operation of the paintball loader 10 in gravity feed mode is desired, the switch 42 is first turned to the off position.

Figure 5:
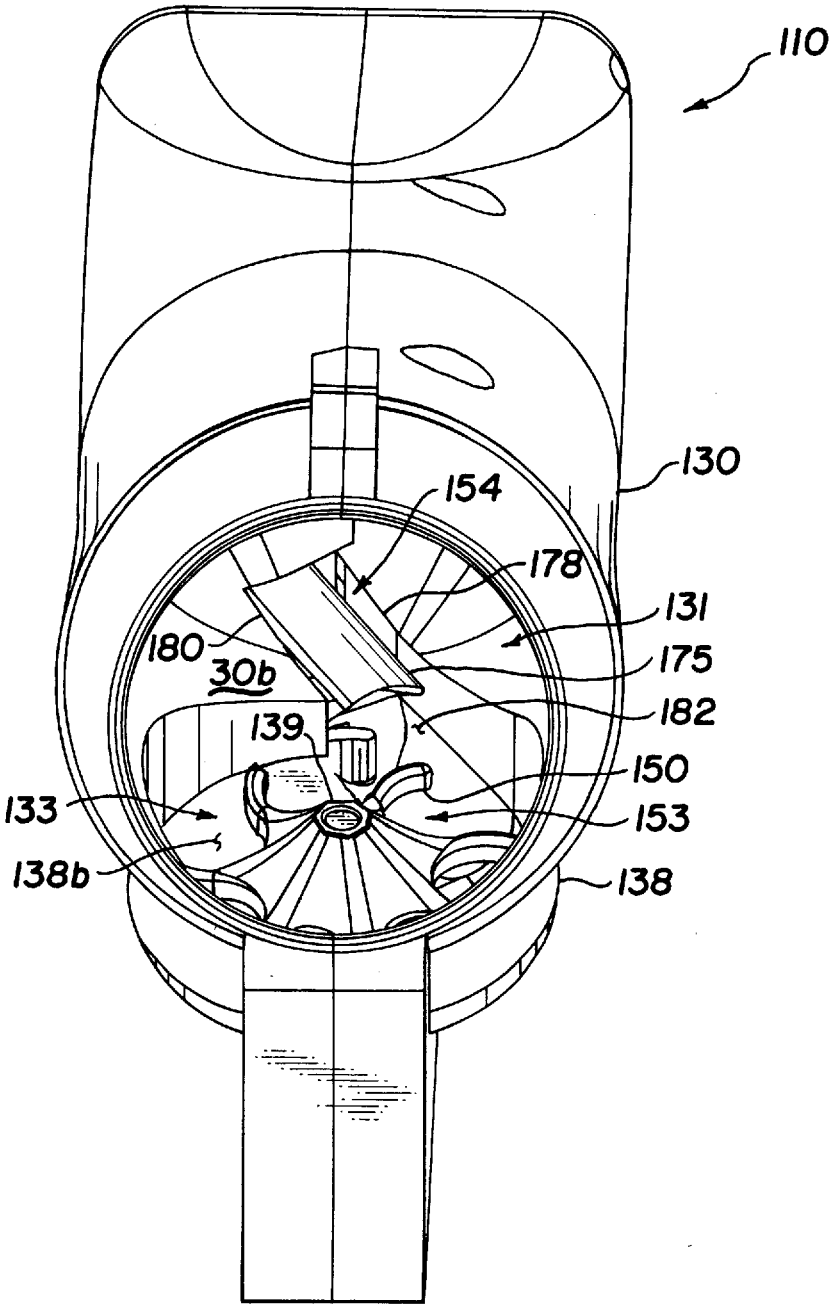
FIG. 5 is a top view of an alternate embodiment of a bulk paintball loader constructed in accordance with the teachings of the present invention.
Figure 6:
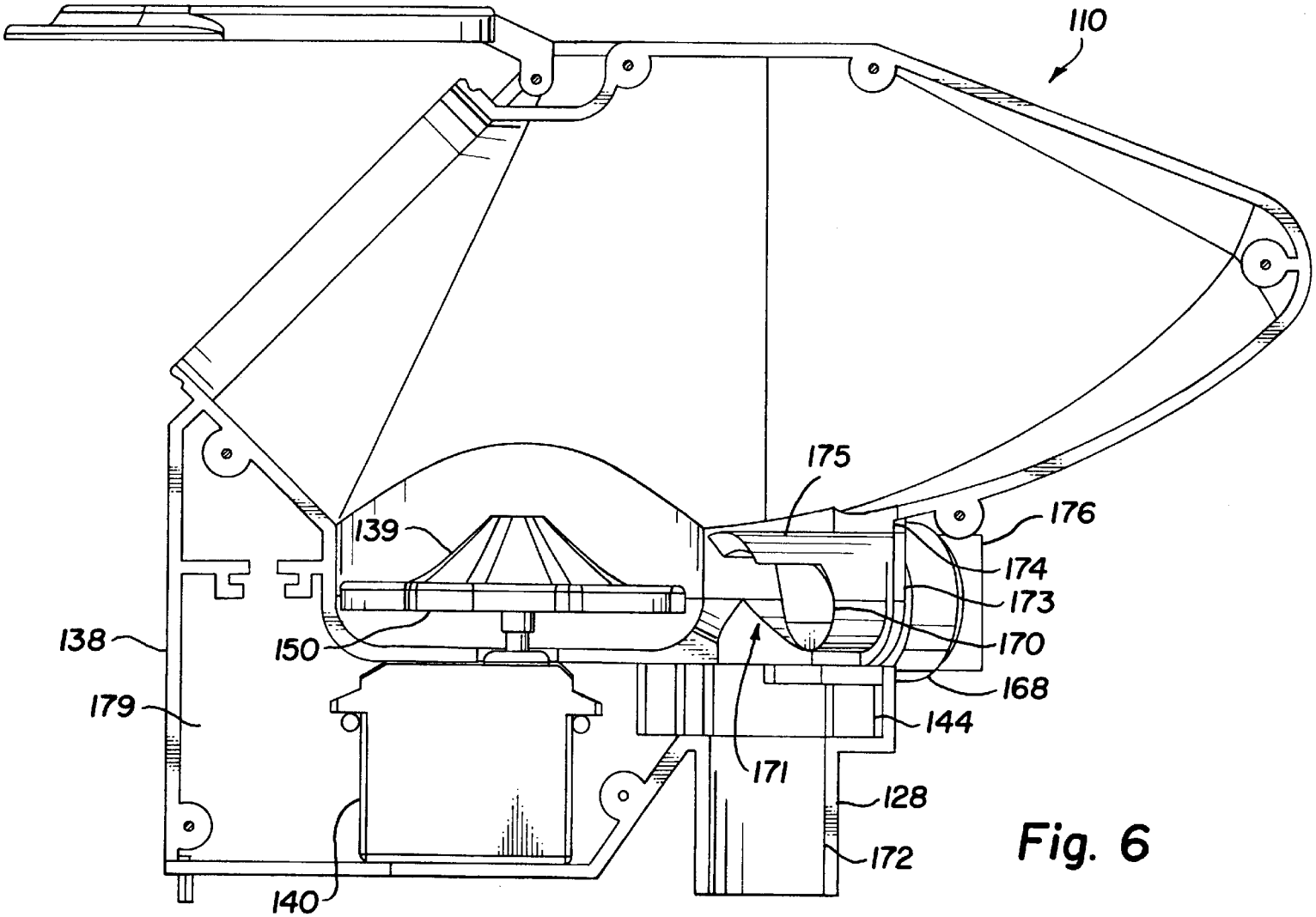
FIG. 6 is a side view of the paintball loader of FIG. 5 with part of a housing portion thereof removed.

Referring next to FIGS. 5–6, an alternate embodiment of a paintball loader constructed in accordance with the teachings of the present invention will now be described in greater detail. In this embodiment, a paintball loader 110 having an alternately configured active feed mechanism is disclosed. Similar to the previously disclosed embodiment, the paintball loader 110 includes a main body portion 130 and a lower body portion 138 which respectively define an interior space 131 and a generally cylindrical lowered interior space 133. Rotatable paddle 139 is positioned within the lowered interior space 133 and includes a series of outwardly radiating arms 150 which define a series of recesses 153 in which paintballs may be held. As the paddle 139 rotates, the arms 150 forcibly direct the paintballs towards an interior passageway 172 of an outfeed tube 128. Rather than being directed to the vertically orientated interior passageway 172 by way of a horizontally orientated interior passageway which extends underneath a bottom wall 30*b* of the main body portion 30, here, the paintballs are directed into a horizontally orientated channel 154, located beneath the bottom wall 30*b* of the main body portion 30, formed by exposing interior sidewalls 178 and 180 and interior bottom wall 182 of the main body 130. The channel 154 is sized such that the bottom wall 182 thereof is located in the same general plane as the bottom wall 138*b* of the lower body portion 138.

The active feed mechanism of the loader 110 operates in the same fashion as the loader 10. Again starting from a fully loaded condition where a stack of paintballs (not shown) extends through the interior passageways of the outfeed tube 128 and an infeed tube (not shown) of a paintball gun, an uppermost paintball of the paintball stack blocks an optical switch 144 from closing. As the paintball gun is fired, paintballs in the stack will be dropped, in sequence, into the firing chamber. As depletion of the stack of paintballs begins, the paintball blocking the optical switch 144 from closing will drop lower into the stack and, since no additional paintballs are being forced through the channel 154 and into the outfeed tube 128, the optical switch 144 will close, thereby activating the electric motor which, in turn, causes the paddle 139 to be rotated. As the paddle 139 rotates, paintballs retained in recesses 153 between pairs of adjacent arms 150 and the sidewall 138 are forcibly directed out of the lower interior space 133 and into the channel 154. As the paintballs enter the channel 154, additional paintballs will drop into the recently vacated recesses 153 between the paddle arms 150 where, they too, are retained and forcibly directed towards the channel 154 by continued rotation of the paddle 139. When a sufficient number of paintballs have been forced into the channel 154, the leading paintball will be pushed to a juncture 171 of the channel 154 and interior passageway 174, and into the outfeed tube 128 where the paintball is dropped down interior passageway 172 and onto the paintball stack for replenishment thereof. Depending on the extent of depletion of the stack of paintballs, and the rate at which the remaining paintballs within the stack are being fired from the paintball gun, it may be necessary that a number of paintballs be forced through the channel 154 and dropped into the interior passageway 172 of the outfeed tube 128 before the paintball stack has been replenished sufficiently so that the optical switch 144 opens and the paddle 139 is stopped from further rotation.

As before, the paintball loader 110 is capable of operating in both active and gravity feed modes and directional plug 168 controls the mode of operation for the paintball loader 110. The directional plug 168 includes a curved interior side wall 170 and an elongated top wall 175. The directional plug 168 is inserted into an opening 173 at a second end of the channel 154 to close the opening. The elongated top wall 175 and, to a much lesser extent, the interior side wall 170, of the directional plug 168 may be used to directionally control the flow of paintballs at the juncture 171. More specifically, when the directional plug 168 is inserted into the channel 154, the elongated top wall 175 extends along an open top end of the channel 154 along the entire length thereof, thereby blocking paintballs from dropping from the interior space 130 into the channel 154. As a result, therefore, to enter the channel 154, paintballs must first drop into the lower interior space 133 and, once there, be actively fed into the channel 154 by the paddle 139. Additionally, the curved interior sidewall 170 tends to deflect balls propelled along the channel 154 down towards the interior passageway 172 of the outfeed tube 128.

To operate the loader 110 in gravity-feed mode, the directional plug is removed, and handle 176 of the directional plug 168 is inserted into the opening. By doing so, the second opening 173 of the channel 154 is blocked. However, paintballs are now free to drop from the main body portion 130 and into the channel 154 and the interior passageway 172 of the outfeed tube 128. While, it is still contemplated that, in one aspect of the invention, the directional plug 168 may be rotated 90 degrees to move the elongated top wall 175 so that it will no longer block paintballs from dropping into the channel 154, in this aspect, it will also be necessary to shape the channel 154 to provide sufficient clearance for the elongated top wall 175 when rotated.

Further in accordance with this embodiment, the lower body portion 138 of the paintball loader is shaped to internally house the active feed mechanism. Specifically, as shown in FIG. 6, the lower body portion is shaped to receive the optical switch 144, stepper motor 140 and also includes an interior space 179 in which a power supply may be housed. One advantage to this configuration is that the stepper motor 140 may be positioned directly below the paddle 139, thereby eliminating any need for a complicated gear train to mechanically couple the paddle 139 to the drive shaft of the stepper motor 140.

Figure 7:
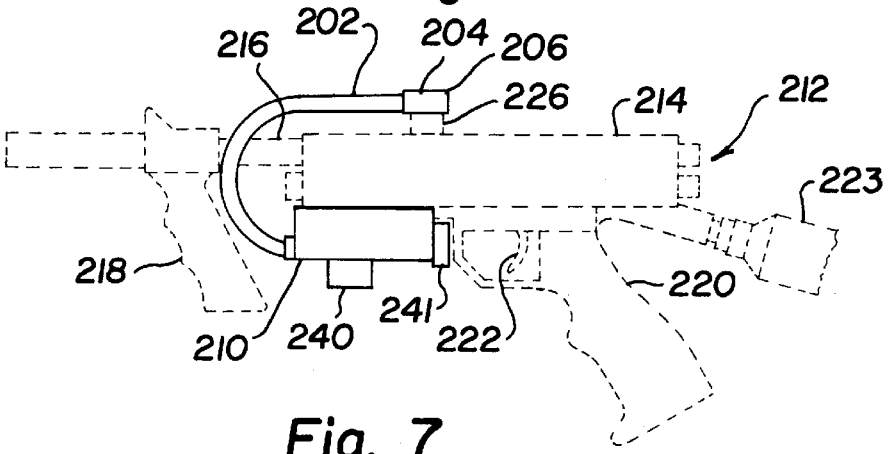
FIG. 7 is a side elevational view of still another alternate embodiment of a bulk paintball loader constructed in accordance with the teachings of the present invention, again operatively attached to a representative paintball gun illustrated in phantom.

Referring next to FIG. 7, another alternate embodiment of a paintball loader constructed in accordance with the teachings of the present invention will now be described in greater detail. As previously noted, one deficiency of gravity feed type loaders disclosed by the prior art is that they require that the loader be located above the infeed tube 26 of the paintball gun 12. However, by providing a loader 10 capable of providing an active feed of paintballs, for example, by forcing paintballs through the generally horizontal interior passageway 54, it is no longer necessary that the loader 10 be physically located above the infeed tube 26. Thus, in the embodiment of the invention illustrated in FIG. 7, a paintball loader 210 is located below the main body portion 214 of the paintball gun 212. Rather than being forced through the interior passageway 54 and then dropped down the interior passageway 72 of the outfeed tube 128, paintballs forced through interior passageway enter the paintball tube 202 where, by the continued forced feed of paintballs thereinto, the paintballs are forced through the tube 202 which, at end 204, is coupled to the infeed tube 226. Coupled to the paintball tube 202 and positioned at the end 204 thereof, is an optical switch 206 which operates identically to the optical switch 44 and similarly connected in series with the stepper motor 240, the power supply 241 and the switch (not shown). Thus, when the infeed tube 226 of the paintball gun is filled with a stack of paintballs such that the stack extends into the end 204 of the tube 202, the optical switch 206 remains open, the motor 240 stays deactivated and the active feed mechanism will not force any additional paintballs into the paintball tube 202. As the paintball gun 210 is fired, however, depletion of the stack of paintballs begins. When the paintball blocking the infrared beam emitted by the optical switch 206 drops into the infeed tube 226, the optical switch 206 closes, thereby activating the stepper motor 240. A paddle (not visible in FIG. 7 but similar in both configuration and position to the paddle 39) again begins to rotate to force additional paintballs into the interior passageway (also not visible but similar in configuration to either the interior passageway 54 or the interior passageway 154) and the paintball tube 202. Of course, the need for the interior passageway could be eliminated by moving the paddle closer to the paintball tube 202 such that paintballs stored in the interior space of the loader 210 are forced directly into the paintball tube 202.

While FIG. 7 illustrates the loader 210 as being mounted below the body portion 214 of the paintball gun 212, by incorporating the disclosed active feed mechanism, it should be clearly understood that the loader 210 may be mounted anywhere to the paintball gun 212. For example, the loader 210 may be mounted to the shoulder rest, for example, as a hollow extension of the shoulder rest in which paintballs are housed.

Thus, there has been described and illustrated herein, a paintball loader having a motor-driven active feed mechanism which forcibly directs paintballs along a generally horizontal passageway to an outfeed tube where they are dropped into an infeed opening of a paintball gun. By providing an active feed mechanism, deficiencies which characterized prior, gravity feed loaders, for example, relatively slow feed rates, have been overcome. Furthermore, unlike gravity feed loaders, paintball loaders having an active feed mechanism are no longer limited to placement above the paintball gun. Instead, if desired, active feed loaders may be placed below the paintball gun. However, those skilled in the art will recognize that numerous modifications and variations from that specifically disclosed herein are possible without substantially departing from the scope of the present invention. It should be clearly understood, therefore, that the embodiment of the invention disclosed herein is considered to be exemplary only and should not be construed as limiting the invention, which is defined only by the claims appended hereto.

What is claimed is:

1. An active feed paintball loader, comprising:

a housing having walls which define an interior space for storing a plurality of paintballs;

a generally vertical outfeed tube having an inlet end through which paintballs fed to said outfeed tube are dropped and an outlet end configured for communication with an infeed tube of a paintball gun;

a generally horizontal interior passageway having openings at first and second ends thereof, said opening at said first end in communication with said interior space of said housing and said opening at said second end in communication with said inlet end of said outfeed tube;

a rotatable paddle positioned in said interior space of said housing, said paddle forcing paintballs out of said interior space and into said interior passageway during rotation thereof;

a motor coupled to said paddle; and a sensor electrically connected to said motor and positioned to detect an absence of a paintball at a specified location within said outfeed tube;

wherein paintballs dropped into said outfeed tube form a paintball stack, said sensor activating said motor to rotate said paddle when said paintball stack has been sufficiently depleted such that said sensor detects said absence and wherein rotation of said paddle forces paintballs through said generally horizontal interior passageway and to said inlet end of said outfeed tube for dropping onto said paintball stack for replenishment thereof.

2. An active feed paintball loader according to claim 1 wherein said paddle further comprises:

a central body portion; and a plurality of arms which extend outwardly from said central body portion;

each one of said plurality of arms spaced apart from an adjacent one of said plurality of arms such that a paintball may be retained therebetween.

3. An active feed paintball loader according to claim 1 wherein said paddle further comprises:

a central body portion having a peripheral edge side surface; and a plurality of arms which extend outwardly from said central body portion;

a edge surface of each one of said plurality of arms, an edge surface of an adjacent one of said plurality of arms and a portion of said peripheral edge side surface of said central body portion which extends therebetween forming a generally semi-circular recess within which a paintball may be retained.

4. An active feed paintball loader, comprising:

a housing having walls which define an interior space for storing a plurality of paintballs;

an interior passageway having openings at first and second ends thereof, said opening at said first end in communication with said interior space of said housing and said opening at said second end configured for communication with an infeed tube of a paintball gun;

a rotatable paddle positioned in said interior space of said housing, said paddle forcing paintballs out of said interior space and into said interior passageway during rotation thereof;

a motor coupled to said paddle; and a sensor electrically connected to said motor and positioned to detect an absence of a paintball at a specified location within said interior passageway;

wherein, upon detecting said absence, said sensor activating said motor to rotate said paddle to force at least one of said plurality of paintballs into said interior passageway;

wherein said paddle further comprises:

a central body portion having a peripheral edge side surface;

a plurality of arms which extend outwardly from said central body portion; and a edge surface of each one of said plurality of arms, an edge surface of an adjacent one of said plurality of arms and a portion of said peripheral edge side surface of said central body portion which extends therebetween forming a generally semi-circular recess within which a paintball may be retained; and wherein said central body portion is generally dome-shaped, said dome-shaped central body portion channeling paintballs towards said semi-circular recesses.

5. An active feed paintball loader, comprising:

a housing having walls which define an interior space for storing a plurality of paintballs;

an interior passageway having openings at first and second ends thereof, said opening at said first end in communication with said interior space of said housing and said opening at said second end configured for communication with an infeed tube of a paintball gun;

a rotatable paddle positioned in said interior space of said housing, said paddle forcing paintballs out of said interior space and into said interior passageway during rotation thereof;

a motor coupled to said paddle; and a sensor electrically connected to said motor and positioned to detect an absence of a paintball at a specified location within said interior passageway;

wherein, upon detecting said absence, said sensor activating said motor to rotate said paddle to force at least one of said plurality of paintballs into said interior passageway;

and wherein said paddle further comprises:

a central body portion;

an intermediate body portion having an upper side surface, a plurality of ridges formed on said upper side surface which divide said upper side surface into a plurality of sections and a peripheral edge side surface, said upper side surface of said intermediate body portion sloping downwardly from said central body portion to said peripheral edge side surface;

a plurality of arms, each one of which radiates outwardly from a corresponding one of said ridges of said intermediate body portion; and an edge surface of each one of said plurality of arms, an edge surface of an adjacent one of said plurality of arms and a portion of said peripheral edge side surface of said intermediate body portion which extends therebetween forming a generally semi-circular recess within which a paintball may be retained;

wherein each section of said upper side surface channels paintballs into one of said semi-circular recesses.

6. An active feed paintball loader according to claim 5, wherein said central body portion is generally dome-shaped, said dome-shaped central body portion channelling paintballs towards said plurality of sections of said intermediate body portion.

7. An active feed paintball loader, comprising:

a housing having walls which define an interior space for storing a plurality of paintballs;

an interior passageway having openings at first and second ends thereof, said opening at said first end in communication with said interior space of said housing and said opening at said second end configured for communication with an infeed tube of a paintball gun;

a rotatable paddle positioned in said interior space of said housing, said paddle forcing paintballs out of said interior space and into said interior passageway during rotation thereof;

a motor coupled to said paddle; and a sensor electrically connected to said motor and positioned to detect an absence of a paintball at a specified location within said interior passageway;

wherein, upon detecting said absence, said sensor activating said motor to rotate said paddle to force at least one of said plurality of paintballs into said interior passageway;

and wherein said interior space defined by said walls of said housing includes a generally cylindrical lowered portion, defined by a lower side wall of said housing, in which said paddle is positioned.

8. An active feed paintball loader according to claim 7 wherein said opening at said first end of said interior passageway is formed in said lower side wall.

9. An active feed paintball loader according to claim 8 wherein said housing further comprises:

a bottom wall; and an interior wall which extends from said bottom wall into said generally cylindrical lowered portion of said interior space, said paddle being positioned above a top side surface of said interior wall;

wherein said interior wall guides paintballs driven by said rotating paddle into said interior passageway.

10. An active feed paintball loader according to claim 9 wherein said interior passageway extends beneath said walls of said housing.

11. An active feed paintball loader according to claim 9 wherein said interior passageway is a generally horizontal interior passageway which extends beneath said walls of said housing.

12. An active feed paintball loader according to claim 11 wherein said paddle further comprises:

a central body portion; and a plurality of arms which extend outwardly from said central body portion;

each one of said plurality of arms spaced apart from an adjacent one of said plurality of arms such that a paintball may be retained between said arms and said lower side wall.

13. An active feed paintball loader according to claim 11 wherein said paddle further comprises:

a central body portion having a peripheral edge side surface; and a plurality of arms which extend outwardly from said central body portion;

a edge surface of each one of said plurality of arms, an edge surface of an adjacent one of said plurality of arms and a portion of said peripheral edge side surface of said central body portion which extends therebetween forming a generally semi-circular recess such that a paintball may be retained between said arms forming said semi-circular recess and said lower side wall.

14. An active feed paintball loader according to claim 11 wherein said paddle further comprises:

a central body portion;

an intermediate body portion having an upper side surface, a plurality of ridges formed on said upper side surface which divide said upper side surface into a plurality of sections and a peripheral edge side surface, said upper side surface of said intermediate body portion sloping downwardly from said central body portion to said peripheral edge side surface;

a plurality of arms, each one of which radiates outwardly from a corresponding one of said ridges of said intermediate body portion;

a edge surface of each one of said plurality of arms, an edge surface of an adjacent one of said plurality of arms and a portion of said outside surface of said central body portion which extends therebetween forming a generally semi-circular recess such that a paintball may be retained between said arms forming said semi-circular recess and said lower wall;

wherein each section of said upper side surface channels paintballs into one of said semi-circular recesses.

15. An active feed paintball loader, comprising:

a housing having walls which define an upper interior space and a lower sidewall which defines a lower interior space in communication with said upper interior space, said upper and lower interior spaces suitable for storing a plurality of paintballs therein;

a generally horizontal interior passageway which extends beneath said walls of said housing and has a first opening at a first end thereof, said first opening at said first end in communication with said lower interior space of said housing;

a generally vertical outfeed tube having an exit aperture at one end thereof through which paintballs entering said outfeed tube are dropped;

said interior passageway having a second opening in communication with an opening in said outfeed tube;

a rotatable paddle positioned in said lower interior space of said housing, said paddle forcing paintballs out of said interior space and into said interior passageway during rotation thereof;

a motor coupled to said paddle; and a sensor electrically connected to said motor and positioned to detect an absence of a paintball at a specified location within said outfeed tube;

wherein, upon detecting said absence, said sensor activating said motor to rotate said paddle to force at least one of said plurality of paintballs through said interior passageway and into said outfeed tube.

16. An active feed paintball loader according to claim 15 wherein said one end of said outfeed tube is adapted for attachment to a paintball gun and said outfeed tube communicates with an infeed tube of said paintball gun.

17. An active feed paintball loader according to claim 15 wherein paintballs entering said outfeed tube form a paintball stack, said sensor activating said motor to rotate said paddle when said paintball stack has been sufficiently depleted such that said sensor detects said absence and wherein rotation of said paddle forces paintballs through said interior passageway and into said outfeed tube for replenishment of said paintball stack.

18. An active feed paintball loader according to claim 17 wherein said housing further comprises:

a bottom wall; and an interior wall which extends from said bottom wall into said lower interior space;

said paddle being positioned above a top side surface of said interior wall;

wherein said interior wall guides paintballs driven by said rotating paddle into said interior passageway.

19. An active feed paintball loader according to claim 17 wherein said outfeed tube has an entrance aperture at another end thereof, said upper interior space in communication with said outfeed tube through said entrance aperture.

20. An active feed paintball loader according to claim 19 wherein said interior passageway has a third opening at a second end thereof and wherein said active feed paintball loader further comprises a directional plug rotatably inserted in said third opening of said interior passageway, said directional plug rotatable between a first position in which said directional plug blocks paintballs from entering said outfeed tube through said entrance aperture and a second position in which paintballs are free to enter said outfeed tube through said entrance aperture.

21. An active feed paintball loader according to claim 20 wherein said second opening in said interior passageway is located between said first and second ends.

22. An active feed paintball loader according to claim 17 wherein said paddle further comprises:

a central body portion; and a plurality of arms which extend outwardly from said central body portion;

each one of said plurality of arms spaced apart from an adjacent one of said plurality of arms such that a paintball may be retained between said arms and said lower side wall.

23. An active feed paintball loader according to claim 17 wherein said paddle further comprises:

a central body portion having a peripheral edge side surface; and a plurality of arms which extend outwardly from said central body portion;

a edge surface of each one of said plurality of arms, an edge surface of an adjacent one of said plurality of arms and a portion of said peripheral edge side surface of said central body portion which extends therebetween forming a generally semi-circular recess such that a paintball may be retained between said arms forming said semi-circular recess and said lower side wall.

24. An active feed paintball loader according to claim 17 wherein said paddle further comprises:

a central body portion;

an intermediate body portion having an upper side surface, a plurality of ridges formed on said upper side surface which divide said upper side surface into a plurality of sections and a peripheral edge side surface, said upper side surface of said intermediate body portion sloping downwardly from said central body portion to said peripheral edge side surface;

a plurality of arms, each one of which radiates outwardly from a corresponding one of said ridges of said intermediate body portion;

a edge surface of each one of said plurality of arms, an edge surface of an adjacent one of said plurality of arms and a portion of said outside surface of said central body portion which extends therebetween forming a generally semi-circular recess such that a paintball may be retained between said arms forming said semi-circular recess and said lower wall;

wherein each section of said upper side surface channels paintballs into one of said semi-circular recesses.

25. For a paintball gun having a body, a firing chamber located in an interior portion of said body and an infeed tube for delivering paintballs to said firing chamber, an active feed paintball loader, comprising:

a housing mounted to said body of said paintball gun, said housing having walls which define an interior space for storing a plurality of paintballs;

a generally vertical outfeed tube having an inlet end though which paintballs fed to said outfeed tube are dropped and an outlet end coupled to said infeed tube of said paintball gun;

an active feed tube having an inlet end in communication with said interior space of said housing and an outlet end coupled to said inlet end of said outfeed tube;

a rotatable paddle positioned in said interior space of said housing, said paddle forcing paintballs out of said interior space and into said active feed tube during rotation thereof;

a motor coupled to said paddle; and a sensor electrically connected to said motor and positioned to detect an absence of a paintball at a specified location within said outfeed tube;

said paintballs dropped into said outfeed tube forming a paintball stack;

said sensor activating said motor to rotate said paddle when said paintball stack has been sufficiently depleted such that said sensor detects said absence and wherein rotation of said paddle forces paintballs into said active feed tube and wherein continued rotation of said paddle pushes said paintballs forced into said active feed tube through said active feed tube and to said outfeed tube for dropping onto said paintball stack for replenishment thereof.

26. An active feed loader according to claim 25 wherein said housing is mounted above said interior chamber.

27. An active feed paintball loader according to claim 25 wherein said walls of said housing further comprises a bottom wall and an interior wall projecting upwardly from said bottom wall, said interior wall guiding paintballs being pushed by rotation of said paddle into said active feed tube.

28. For a paintball gun having a body, a firing chamber located in an interior portion of said body and an infeed tube for delivering paintballs to said firing chamber, an active feed paintball loader, comprising:

a housing mounted to said body of said paintball gun, said housing having walls which define an interior space for storing a plurality of paintballs;

said housing mounted below said firing chamber;

a generally vertical outfeed tube having an inlet end though which paintballs fed to said outfeed tube are dropped and an outlet end coupled to said infeed tube of said paintball gun;

an active feed tube having an inlet end in communication with said interior space of said housing and an outlet end coupled to said inlet end of said outfeed tube;

a rotatable paddle positioned in said interior space of said housing, said paddle forcing paintballs out of said interior space and into said active feed tube during rotation thereof;

a motor coupled to said paddle; and a sensor electrically connected to said motor and positioned to detect a n absence of a paintball at a specified location within said outfeed tube;

said paintballs dropped into said outfeed tube forming a paintball stack;

said sensor activating said motor to rotate said paddle when said paintball stack has been sufficiently depleted such that said sensor detects said absence and wherein rotation of said paddle forces paintballs through said active feed tube and to said outfeed tube for dropping onto said paintball stack for replenishment thereof.

29. An active feed paintball loader according to claim 28 wherein said paddle further comprises:

a central body portion; and a plurality of arms which extend outwardly from said central body portion;

each one of said plurality of arms spaced apart from an adjacent one of said plurality of arms such that a paintball may be retained therebetween.

30. An active feed paintball loader according to claim 28 wherein said paddle further comprises:

a central body portion having a peripheral edge side surface; and a plurality of arms which extend outwardly from said central body portion;

a edge surface of each one of said plurality of arms, an edge surface of an adjacent one of said plurality of arms and a portion of said peripheral edge side surface of said central body portion which extends therebetween forming a generally semi-circular recess within which a paintball may be retained.

31. An active feed paintball loader according to claim 28 wherein said paddle further comprises:

a central body portion;

an intermediate body portion having an upper side surface, a plurality of ridges formed on said upper side surface which divide said upper side surface into a plurality of sections and a peripheral edge side surface, said upper side surface of said intermediate body portion sloping downwardly from said central body portion to said peripheral edge side surface;

a plurality of arms, each one of which radiates outwardly from a corresponding one of said ridges of said intermediate body portion;

a edge surface of each one of said plurality of arms, an edge surface of an adjacent one of said plurality of arms and a portion of said outside surface of said central body portion which extends therebetween forming a generally semi-circular recess within which a paintball may be retained;

wherein each section of said upper side surface channels paintballs into one of said semi-circular recesses.

32. An active feed paintball loader, comprising:

a housing having walls which define an upper interior space and walls which defines a lower interior space in communication with said upper interior space, said upper and lower interior spaces suitable for storing a plurality of paintballs therein;

a channel formed in a bottom wall of said walls which define said upper interior space, said channel having a generally horizontal bottom wall and a first opening at a first end thereof, said first opening at said first end in communication with said lower interior space of said housing;

a generally vertical outfeed tube having an exit aperture at one end thereof through which paintballs entering said outfeed tube are dropped;

said channel having a second opening in communication with an opening in said outfeed tube;

a rotatable paddle positioned in said lower interior space of said housing, rotation of said paddle forcing paintballs out of said interior space and into said channel through said first opening thereof;

a motor coupled to said paddle; and a sensor electrically connected to said motor and positioned to detect an absence of a paintball at a specified location within said outfeed tube;

wherein, upon detecting said absence, said sensor activating said motor to rotate said paddle to force at least one of said plurality of paintballs through said channel and into said outfeed tube.

33. An active feed paintball loader according to claim 32 wherein said one end of said outfeed tube is adapted for attachment to a paintball gun and said outfeed tube communicates with an infeed tube of said paintball gun.

34. An active feed paintball loader according to claim 32 wherein paintballs entering said outfeed tube form a paintball stack, said sensor activating said motor to rotate said paddle when said paintball stack has been sufficiently depleted such that said sensor detects said absence and wherein rotation of said paddle forces paintballs through said channel and into said outfeed tube for replenishment of said paintball stack.

35. An active feed paintball loader according to claim 34 wherein said walls which define said lower interior space further comprises:

a bottom wall;

an interior wall which extends from said bottom wall into said lower interior space;

said paddle being positioned above a top side surface of said interior wall;

wherein said interior wall guides paintballs driven by said rotating paddle into said channel.

36. An active feed paintball loader according to claim 32 wherein said channel has a third opening at a second end thereof and wherein said active feed paintball loader further comprises a directional plug inserted in said third opening of said channel, said directional plug having an elongated top wall which blocks paintballs from entering said channel through an open top end thereof.

37. An active feed paintball loader according to claim 32 wherein said paddle further comprises:

a central body portion; and a plurality of arms which extend outwardly from said central body portion;

each one of said plurality of arms spaced apart from an adjacent one of said plurality of arms such that a paintball may be retained between said arms and said lower side wall.

38. An active feed paintball loader according to claim 32 wherein said paddle further comprises:

a central body portion having a peripheral edge side surface; and a plurality of arms which extend outwardly from said central body portion;

a edge surface of each one of said plurality of arms, an edge surface of an adjacent one of said plurality of arms and a portion of said peripheral edge side surface of said central body portion which extends therebetween forming a generally semi-circular recess such that a paintball may be retained between said arms forming said semi-circular recess and said lower side wall.

39. An active feed paintball loader according to claim 32 wherein said paddle further comprises:

a central body portion;

an intermediate body portion having an upper side surface, a plurality of ridges formed on said upper side surface which divide said upper side surface into a plurality of sections and a peripheral edge side surface, said upper side surface of said intermediate body portion sloping downwardly from said central body portion to said peripheral edge side surface;

a plurality of arms, each one of which radiates outwardly from a corresponding one of said ridges of said intermediate body portion;

a edge surface of each one of said plurality of arms, an edge surface of an adjacent one of said plurality of arms and a portion of said outside surface of said central body portion which extends therebetween forming a generally semi-circular recess such that a paintball may be retained between said arms forming said semi-circular recess and said lower wall;

wherein each section of said upper side surface channels paintballs into one of said semi-circular recesses.

* * * * *